United States Patent [19]

Zettler

[11] 4,203,334

[45] May 20, 1980

[54] PROCESS AND APPARATUS FOR CUTTING SHEETS INTO INDIVIDUAL SHEETS AND SUBSEQUENT ORDERLY STACKING OF THE INDIVIDUAL SHEETS

[76] Inventor: Franz Zettler, Alpenstrasse 5, 8930 Schwabmuenchen, Fed. Rep. of Germany

[21] Appl. No.: 920,481

[22] Filed: Jun. 29, 1978

[30] Foreign Application Priority Data

Jul. 8, 1977 [DE] Fed. Rep. of Germany ..... 2731023

[51] Int. Cl.[2] ..... B65H 5/24

[52] U.S. Cl. ..... 83/23; 83/29; 83/86; 83/277; 83/282; 83/422; 271/151

[58] Field of Search ..... 83/23, 42, 256, 255, 83/277, 282, 404, 422, 29, 86; 271/151, 269

[56] References Cited

U.S. PATENT DOCUMENTS

| | | | |
|---|---|---|---|
| 2,639,772 | 5/1953 | Sandberg et al. | 83/404 X |
| 3,034,783 | 5/1962 | Christa | 271/269 X |
| 3,670,614 | 6/1972 | Streckert | 83/255 X |
| 3,688,619 | 9/1972 | Yabuta | 83/404 X |
| 3,710,667 | 1/1973 | Kluger | 83/256 X |
| 3,980,297 | 9/1976 | Bulso, Jr. et al. | 271/269 |
| 3,981,212 | 9/1976 | McCain et al. | 83/404 X |
| 4,041,818 | 8/1977 | Rummer | 83/404 X |

*Primary Examiner*—Frank T. Yost

*Attorney, Agent, or Firm*—Blanchard, Flynn, Thiel, Boutell & Tanis

[57] ABSTRACT

A process and an apparatus for manufacturing books, blocks or calendars by cutting large sheets having printed thereon different pages into smaller sheets which must be brought into an orderly succession before the pages or sheets are bound. The usual folding of the large sheets can be omitted, in that the sheets are fed individually and successively to a conveyor means and are conveyed towards a cutting means; the individual sheets are stacked in a partially overlapping manner. The cutting of the sheets is effected whenever predetermined widths of the individual sheets have been conveyed through the cutting means.

14 Claims, 7 Drawing Figures

PROCESS AND APPARATUS FOR CUTTING SHEETS INTO INDIVIDUAL SHEETS AND SUBSEQUENT ORDERLY STACKING OF THE INDIVIDUAL SHEETS

The invention relates to a process and apparatus for cutting sheets into individual sheets and orderly stacking of the individual sheets.

In the production of printed pads, brochures, books and the like, there is the problem that the pages or sheets which are mostly different and which are printed on large sheets must be brought into an orderly succession before the pages or sheets are bound or sewn. Usually operation is effected in such a way that the large sheets are folded a number of times and only then are the large sheets cut and severed at the desired positions, to form the individual sheets. The disadvantage of this known process lies on the one hand in the relatively complicated operating step of folding the large sheets, which can only be incorporated into a continuous processing operation with some difficulty, and which requires separate machines, and on the other hand in a high rate of paper wastage.

The invention is based on the problem of providing a process of the kind set out above, in which sheets may be cut into individual sheets and the individual sheets may subsequently be stacked in an orderly manner, in a simple and economical manner, while omitting the folding operation.

The process according to the invention is characterised in that the sheets to be cut are fed individually or in groups successively to a conveyor means and are conveyed towards a cutting means, and that cutting is effected whenever the sheets to be cut, which lie one upon the other in a partially overlapping manner, have been conveyed through the cutting means by the width of the individual sheets.

The invention also provides apparatus which permits simplified processing of this kind. This apparatus is characterised in that there is provided a conveyor means to which sheets to be cut are fed individually or in groups and which conveys the sheets to be cut towards a cutting means, and that the cutting means is actuated whenever the sheets to be cut, which lie one upon the other in a partially overlapping manner, have been passed through the cutting means by the width of the individual sheets.

Figure 2:
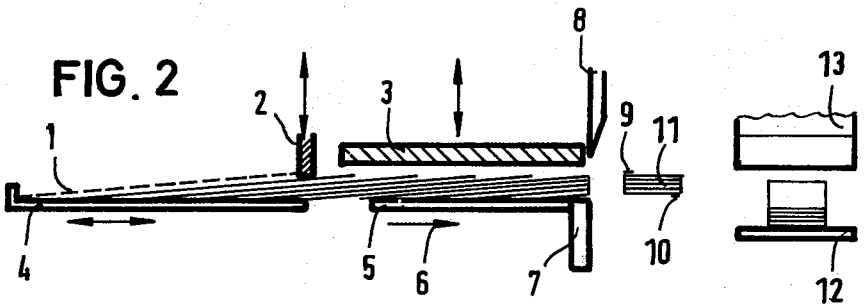
Figure 1:
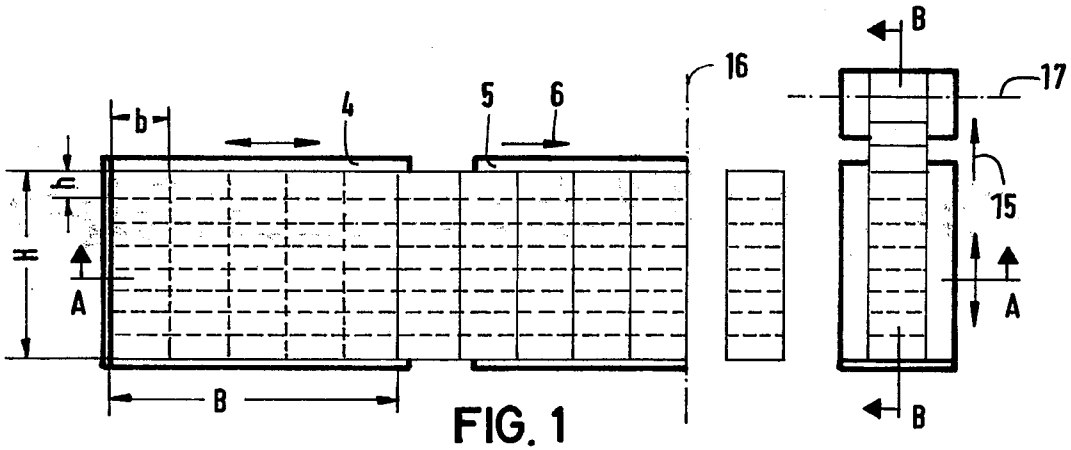
Figure 3:
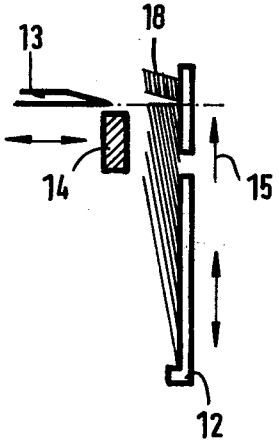
Figure 5:
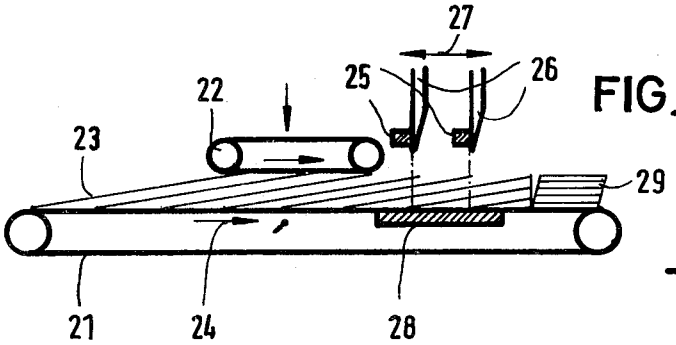
Figure 4:
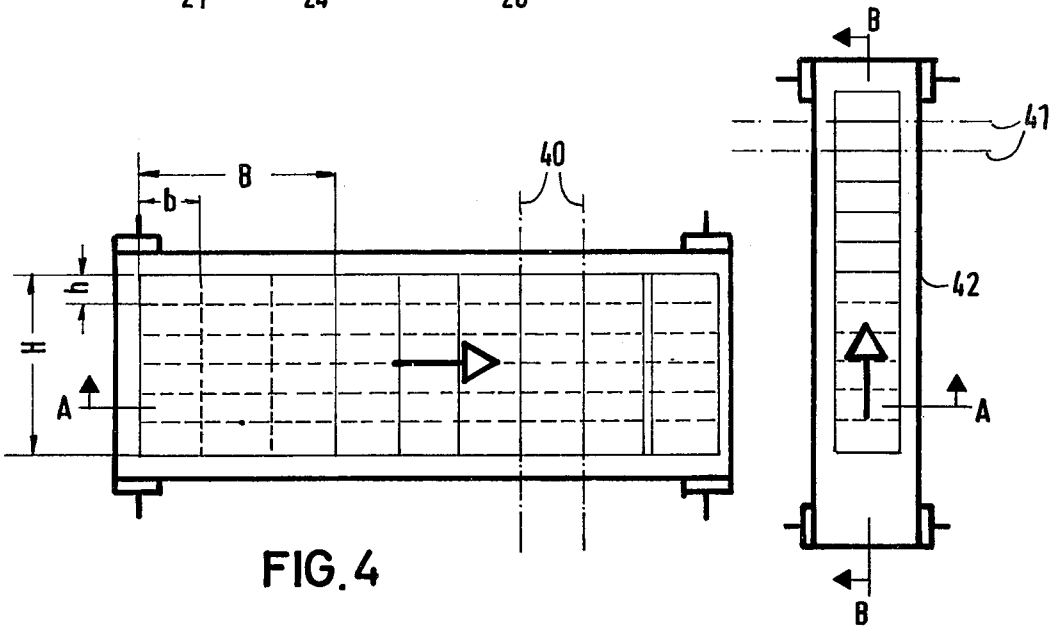
Figure 6:
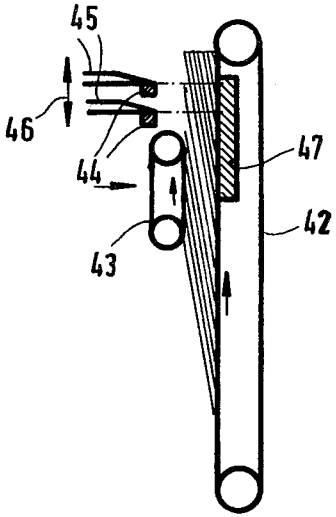
Figure 7:
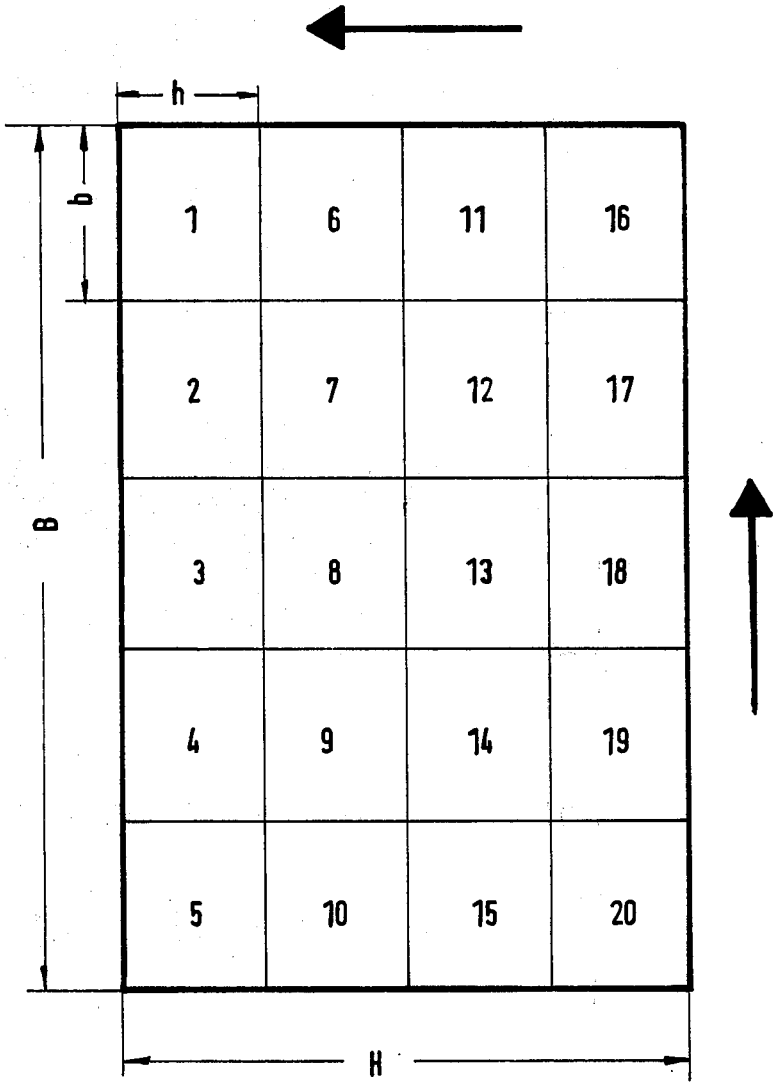

Further features of the invention and advantages thereof will be apparent from the following description given with reference to the drawings, in which:

FIG. 1 shows a plan view of apparatus, illustrated in diagrammatic form, for carrying out the process in a first embodiment, FIG. 2 shows a view in section taken along line A—A in FIG. 1, FIG. 3 shows a view of the apparatus of FIG. 1 in section taken along line B—B, FIG. 4 shows a diagrammatic plan view of the apparatus for carrying out the process, in a second alternative embodiment, FIG. 5 shows a view in section taken along line A—A in FIG. 4, FIG. 6 shows a view of the apparatus of FIG. 4 in section taken along line B—B, and FIG. 7 shows an example of a sheet which is to be cut into individual sheets in the sequence indicated by rising numbers.

In the process according to the invention, sheets 1 of material, which are of dimensions B×H are to be processed to form an orderly stack 11 of strips of material. In most cases the requirement is for individual pages of dimensions b×h so that this first operation is followed by a similar processing operation which is preferably effected perpendicularly with respect to the flow of material in the first operation.

The sheet 1 of material comprises for example paper, cardboard, plastics material, metal foil or similar flat material. The intermediate product (which in many cases may also be the end product) is an orderly stack of strips measuring b×H, and the end product is an orderly stack of individual sheets measuring b×h, in the sequence as shown in FIG. 6. Instead of a single sheet of material, it is also possible to use folded sheets or groups of sheets which comprise a plurality of sheets to be cut.

In the first alternative embodiment of the process according to the invention, the movements are effected in a stepwise manner. As can be seen from FIGS. 1 to 3, there is provided a conveyor table 4 or a similar depositing means which is movable horizontally to a cutting means 7, 8 and back again to its starting position. A hold-down means 2 is movable in a predominantly perpendicular direction and is provided for holding down the sheets to be cut which are disposed on the table 4, and at the same time serving as a stop for sheets of material which are to be freshly deposited on the table.

Disposed downstream of the conveyor means 4 is a depositing table 5 on to which the partially overlapping layers of sheets 1 are conveyed from the conveyor table 4. Disposed above the table 5 is a further hold-down means 3 which is operated alternately with respect to the hold-down means 2.

Conveying of the sheets of material to be cut is effected in step units which correspond to the width b of the individual sheets.

The apparatus operates as follows:

A sheet of material 1 is laid on the table 4 and, for each sheet of material fed into position, the table 4 moves in the direction 6 towards the blade 7, 8, by the width b of the individual sheet size to be cut. When it has reached the most forward point of its movement, the sheet 1 is retained by the downwardly moving hold-down means 3. With the hold-down means 2 in an open condition, the table returns to its starting position, without a sheet of material, and permits a fresh sheet of material to be laid on the table. This operation is repeated continuously, with the hold-down means 2 retaining the material which builds up in thickness in a partially overlapping manner during the forward feed movement of the table, and thus providing for reliable forward feed movement 6. When the table returns (with the hold-down means 2 in the open condition), the lowered hold-down means 3 prevents the material from also returning. The material which is transported below the blade 7, 8 in this manner is cut. This results in layers of strips of material, measuring b×H. Depending on the particular size B×H of the starting format and the height b of the individual sheet format cut, this operation, after adjustment has been effected, provides a number of strips of material which is always the same. The operation of arranging the material in a partially overlapping manner is now repeated in a lateral direction. This time the layer 11 of strips of material is the starting material. It is laid on the reciprocally movable table 12. The lateral feed movement in the direction 15 towards the blade 13 corresponds to the dimension h.

The hold-down means 14 prevents the strips of material from remaining behind. The blade 13 finally cuts off a stack which is of the final size b×h.

All the individual sheet formats of a sheet 1 of material to be cut are associated with given individual sheet formats of the other sheets of material to be cut, because the positioning is always the same. Therefore, individual sheet formats may be processed (printed) differently before the collating operation, while the processing operation, for example by the printer, may be performed in a desired sequence.

Reference numerals 16 and 17 indicate the cutting planes for cutting the strips 11 of material or the final sheet formats. Reference numerals 9 and 10 denote the extremely small pieces of wasted paper which are produced in each complete stack of strips. In FIG. 3, reference numeral 18 denotes the finished stack which is arranged in accordance with the desired sequence and which is now passed for further processing, for example sewing or glueing.

The step unit of the movement of the conveyor table 4 is preferably adjustable so that different widths b can be produced. The same also applies to the conveyor table 12 for the transverse conveying movement. The transition from the longitudinal conveying movement to the transverse conveying movement is effected mechanically or pneumatically by gripping arms or similar movement means, whenever a corresponding stack 11 has been completely formed.

It is important with the invention that the different movements are synchronised with respect to each other, that is to say, that the feed movement of the sheets 1 of material to be cut, the movement of the table 4 and of the hold-down means 2, 3, and actuation of the blade 7, 8, and also the movement of conveying the strips 11 of material away, are in a fixed relation with each other, although this relation is adjustable according to the dimensions of the desired final sheet sizes.

FIGS. 4 and 6 show another embodiment of apparatus as may be used for another alternative embodiment of the process according to the invention.

In this case the conveyor means is in the form of conveyor belts 21 and 42 which could also be replaced by conveyor drums. Although the first alternative form of the process according to the invention, namely the stepwise conveying movement, could also be performed with the conveyor belt, this conveyor belt is particularly suitable for continuous operation. The conveyor belt is moved in direction 24, preferably at a constant speed. Sheets 23 of material to be cut are fed stepwise to the conveyor belt, the feed speed depending on the conveyor speed of the conveyor belt 24 and the dimensions of the final sheet sizes. It is possible to provide a plurality of cutting means 26 which are actuated alternately or simultaneously, this also being dependent on the feed and conveying speed of the sheets of material to be cut.

In this embodiment the cutting means 26 are shown in the form of impact blades which strike against a support member 28, but the cutting means may be in the form of planar or rotary impact blades. The conveyor belt comprises a resistant material, preferably nylon, which will be worn out by the blades only after a long period of operation. Hold-down means 25 are pressed against the paper in the cutting operation; the hold-down means 25 are either moved separately from the blades or are secured to the blades, leaving free the cutting edge. The distance of the blades from each other is preferably adjustable so that different sheet sizes can be processed. This adjustability is indicated by the arrow 27. This kind of processing operation again produces a stack 29 of strips of material, the stack being transferred to the transverse conveying means by way of suitable gripping means.

The transverse conveying means may be constructed in a similar manner and may operate like the apparatus described above. It is also possible however to use a combination with the apparatus as shown in FIGS. 1 to 3, just as the longitudinal conveying movement could be in accordance with alternative form 1 and the transverse conveying operation could be in accordance with alternative form 2.

FIGS. 4 to 6 show an alternative form of a hold-down means which in this second embodiment is in the form of a conveyor belt 22. One or more juxtaposed rollers could also be used instead of the conveyor belt.

As already mentioned above, a similar arrangement is provided for the transverse conveying movement, in which the components of the arrangement are denoted by the following reference numerals: the planes of the blades are denoted by reference numerals 40 and 41; further corresponding components are conveyor belt 42, counter-plate 47, hold-down means 43, hold-down means 44; blades 45 and arrow 46 indicating adjustability.

Apart from the continuous conveying movement, the mode of operation of this apparatus is similar to that of the first alternative embodiment. In detail, operation is as follows:

One sheet 23 of material to be cut, of dimensions B×H, after the other is deposited on a conveyor belt 21 which moves continuously in the direction 24. The difference in time between two sheets of material which are deposited in this way results in the sheets forming a partially overlapping configuration. The speed of the conveying movement is to be so adjusted that the overlapping is equal to the size of the sheet format to be cut. The material which moves in a partially overlapping manner in this way is held fast by the hold-down means 22 which moves at the same speed. The blade or blades 26 cut off the layers 29 of strips of material. These strips are deposited, also in a partially overlapping configuration, on a second conveyor belt 42. The moving and stationary hold-down means 43 and 44 respectively permit the final sheet sizes to be cut off by the blade or blades 45.

The second alternative form of the process according to the invention has the advantage of continuous operation, while a considerable increase in speed is also possible.

When the sheets of material to be cut are conveyed rapidly, it would also be possible to envisage reducing the speed during the cutting operation, in order to obtain a precise cut.

In the description, the first dimension mentioned was the width of the individual sheet sizes. It will be appreciated that operation may also begin with the other dimension, namely the height of the sheet.

For the sake of clarity, it should again be mentioned that, in the transverse processing operation, a respective layer of strips of material corresponds to a sheet 1 of material to be cut in the longitudinal processing operation. Therefore the layers of strips of material are arranged in succession in a partially overlapping manner on the conveyor table 12 or on the conveyor belt 42 respectively.

The invention is particularly adapted for the production of date blocks and calendars.

I claim:

1. A process for cutting sheets each into a plurality of sheets and thereby forming an orderly stack of said cut individual sheets, comprising:

partially overlapping sheets to be cut and conveying the partially overlapped sheets by a conveyor means towards a cutting means;

cutting the partially overlapped sheets where they overlap, after conveying same through the cutting means by the width of a said individual sheet to separate a stack of individual sheets from the partially overlapping sheets; and adding further sheets to partially overlap those on said conveyor means as successive stacks of individual sheets are cut off.

2. A process according to claim 1, wherein individual cut sheets are stacked up until they reach a desired height, and are then conveyed away.

3. A process according to claim 2, wherein the resulting stacks of individual cut sheets are again subjected to the same process but in the direction of their length.

4. A process according to claim 1, wherein the partially overlapped sheets to be cut are conveyed in steps which correspond to the width of the individual sheets to be processed and that the adding of sheets, the sheet conveying movement and the cutting operation are synchronized with each other and the movement of conveying the individual sheets away may additionally be synchronized therewith.

5. A process according to claim 1, including using a reciprocating table as the conveying means, holding overlapping sheets on said table with a first hold-down means while advancing said table toward said cutting means to advance overlapping sheets protruding forwardly beyond said table along a fixed table toward said cutting means, clamping said advancing partially overlapped sheets to said fixed table with a second hold-down means and releasing said first hold-down means, retracting said conveying table away from said fixed table so the former moves under and with respect to the trailing edges of said partially overlapped sheets, the adding of further sheets to partially overlap those on the conveying table including backing the leading edge of a new sheet on said first hold-down means to position same in partially overlapping fashion with sheets previously fed onto said conveyor means.

6. A process according to claim 1, in which said conveying by said conveyor means is by a belt conveyor and in which the adding of further sheets to partially overlap those on the conveyor means is carried out by timed addition of further sheets to the input end of the conveyor means and including holding down the partially overlapped sheets during the cutting step by a hold-down means preceding said cutting means.

7. Apparatus for cutting sheets each into a plurality of individual sheets and thereby forming an orderly stack of said individual sheets, comprising:

a conveyor means for conveying partially overlapping sheets to be cut towards a cutting station;

cutting means at said cutting station actuable for cutting through the overlapping parts of the partially overlapping sheets when the latter have been passed through the cutting means by the width of the individual sheets; and hold-down means above said conveyor means cooperating with said cutting means and actuable for pressing said partially overlapping sheets thereagainst to maintain the preselected partial overlap of such sheets.

8. Apparatus according to claim 7, wherein the conveyor means comprises a conveyor table movable towards the cutting means and back in steps which correspond to the width of the individual sheets, said hold-down means being adjacent and upstream of the cutting means, which hold-down means in the forward and backward movement of the table respectively press the sheets to be cut against the table and against a support for the cutting means.

9. Apparatus according to claim 7, wherein the conveyor means is an endless rotating conveyor member and that the conveyor means is moved which correspond to the width of the individual sheets.

10. Apparatus according to claim 9, wherein the conveyor means is moved in steps substantially continuously.

11. Apparatus according to claim 7, wherein a plurality of cutting means are arranged in succession in the direction of the conveying movement of the sheets to be cut.

12. Apparatus according to claim 7, wherein the cutting means are of a shears-like construction.

13. Apparatus according to claim 7, wherein the cutting means are in the form of impact blades movable synchronously with said hold-down means.

14. Apparatus according to claim 7, including at least one hold-down means having a rotating endless surface operated synchronously with the conveyor means.

* * * * *

UNITED STATES PATENT OFFICE

CERTIFICATE OF CORRECTION

Patent No. 4 203 334 Dated May 20, 1980

Inventor(s) Franz Zettler

It is certified that error appears in the above-identified patent and that said Letters Patent are hereby corrected as shown below:

Column 6, line 33; after "moved" insert ---in steps---.

Column 6, line 36; delete "in steps".

Signed and Sealed this

*Fifth* Day of *August 1980*

[SEAL]

*Attest:*

SIDNEY A. DIAMOND

*Attesting Officer* *Commissioner of Patents and Trademarks*